US006203222B1

(12) United States Patent
Wakabayashi et al.

(10) Patent No.: US 6,203,222 B1
(45) Date of Patent: Mar. 20, 2001

(54) PRINTER HEAD DEVICE AND PRINTER IMAGE PROCESSING SYSTEM HAVING THE SAME

(75) Inventors: Kazuo Wakabayashi; Saburo Imai, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/264,459

(22) Filed: Mar. 8, 1999

(30) Foreign Application Priority Data

Mar. 9, 1998 (JP) ..... 10-057219
Jan. 13, 1999 (JP) ..... 11-006805

(51) Int. Cl.[7] ..... B41J 2/315

(52) U.S. Cl. ..... 400/118.3; 399/107; 399/118; 399/206; 359/894; 359/867; 101/486; 347/241; 347/244

(58) Field of Search ..... 400/711, 118.3; 101/489, 486; 355/54, 104, 132, 402, 406; 359/641, 642, 654, 894, 867; 399/107, 118, 140, 144, 206, 218; 347/741, 244; 353/25, 38

(56) References Cited

U.S. PATENT DOCUMENTS 3,704,068 * 11/1972 Waly ..... 353/25
3,898,005 * 8/1975 Roberts ..... 355/54
4,073,650 * 2/1978 Yevick ..... 353/38
4,821,051 4/1989 Hediger ..... 346/155
4,896,168 1/1990 Newman et al. ..... 346/107 R
5,117,309 * 5/1992 Aoki ..... 359/654
5,191,358 * 3/1993 Iwasaki ..... 347/244
5,257,038 * 10/1993 Ferschz et al. ..... 347/244
5,444,520 * 8/1995 Murano ..... 347/244
5,552,820 * 9/1996 Genovese ..... 347/244
5,642,149 * 6/1997 Palum ..... 347/241
5,884,114 * 3/1999 Iwasaki ..... 355/406
5,893,662 * 4/1999 Ito ..... 399/107

FOREIGN PATENT DOCUMENTS

864431A1 9/1998 (EP) .

* cited by examiner

*Primary Examiner*—Eugene Eickholt
(74) *Attorney, Agent, or Firm*—Adams & Wilks

(57) ABSTRACT

A head for a printer and an image processing system is provided in which light emitted from light emitting elements formed on a substrate of the head does not leak from pinholes of a non-corresponding light emitting elements and does not interfere with light emitted by other light emitting elements, so that satisfactory printing can be carried out. An aperture has on opposite ends sandwiching portions and covers a substrate to sandwich a carriage. Concave portions are formed correspondence with light emitting elements. Pinholes are provided in a front wall and an insulating black coat is formed on the surfaces of the concave portions to prevent a short circuit. Light from the light emitting elements which does not pass through the pinholes is absorbed by the surfaces of the concave portions.

9 Claims, 4 Drawing Sheets

PRINTER HEAD DEVICE AND PRINTER IMAGE PROCESSING SYSTEM HAVING THE SAME

BACKGROUND OF THE INVENTION

1. Field of the Invention

The present invention relates to a printer for printing image information or the like, and more particularly, to a printer of an optical writing type which carries out a printing operation by irradiating light corresponding to image information or the like from light emitting elements onto printing paper of a photosensitive microcapsule type.

2. Description of the Related Art

A conventional printer head device is structured such that flashing light emitted according to image data by a plurality of light emitting diodes forming a print head formed on a substrate provided on a carriage guided by a carriage guide and reciprocated by a motor is, after the light diameter is decreased by pinholes of a given aperture, irradiated onto printing paper. The light emitting diodes are extremely small. A top portion that emits light and a connection portion formed on a substrate are connected by two bonding conductors. Since the distance from an aperture to the substrate is relatively large so as to prevent the aperture from contacting the light emitting diodes and to prevent the two bonding conductors from short circuiting, the emitted light leaks out from a pinhole of a non-corresponding position of the aperture to affect the image. Further, at the same time, since the distance from the light emitting diodes to the printing paper is large, there is also a problem in that the light energy received on the printing paper is small.

Further, in the conventional printer head device, there is a fear that, due to heat accompanying the flashing light emitted by the light emitting diodes, the temperature of the substrate and the aperture may rise above the melting point of plastic forming the carriage (about 130° C., for example) to melt or change the shape of a substrate supporting portion of the carriage leading to change in the substrate supporting state, and also, that heat irradiation from the aperture may cause color change or color development of the printing paper to degrade the print quality.

SUMMARY OF THE INVENTION

An object of the present invention is to provide a printer head device with which light emitted from a plurality of light emitting elements mounted on a substrate forming a head does not leak out from a pinhole of a non-corresponding position of an aperture and the light energy received on printing paper can be made larger, and which can be sufficiently attached to the aperture and can cool the substrate and the aperture, and to provide a printer having the head device and an image processing system having the printer.

In order to solve the above problems, according to the present invention, a printer head device having light emitting elements for irradiating light onto printing paper to carry out printing is comprised of: an aperture member having concave portions corresponding to the arrangement of said light emitting elements; and pinholes substantially at the center of said respective concave portions for decreasing a diameter of the light emitted by said light emitting elements, in which said aperture member is arranged so that at least a part of said light emitting elements are housed therein without contacting said concave portions.

In the head device structured in this way, it is preferable that insulating black coat is formed in at least on the concave portions.

Further, in the respective structures mentioned above, the printer head device may be structured by providing the light emitting elements on a substrate, forming the aperture member of a metal having a high heat conductivity, and arranging the aperture member so as to be in contact with the substrate.

Further, in the respective structures mentioned above, the aperture member may have sandwichingly fixing portions for sandwichingly fixing a carriage.

The metal having a high heat conductivity is preferably copper or a copper alloy, and more preferably, phosphor bronze.

Further, the printer head device may be structured such that the substrate is formed of a metal having a high heat conductivity, and a heat radiating means for radiating-heat of the substrate is further provided.

Further, according to the present invention, a printer having a head device based on the respective structures mentioned above functions as follows: emitting light by the light emitting elements; decreasing the diameter of the light by the aperture portions; and irradiating the light onto a printing paper to produce an image on the printing paper.

Further, according to the present invention, an image processing system connecting the printer with an image processing apparatus is comprised of: transmitting/receiving image signals between the image processing apparatus and the printer to produce an image on the printing paper.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFER ED EMBODIMENTS

Figure 1:
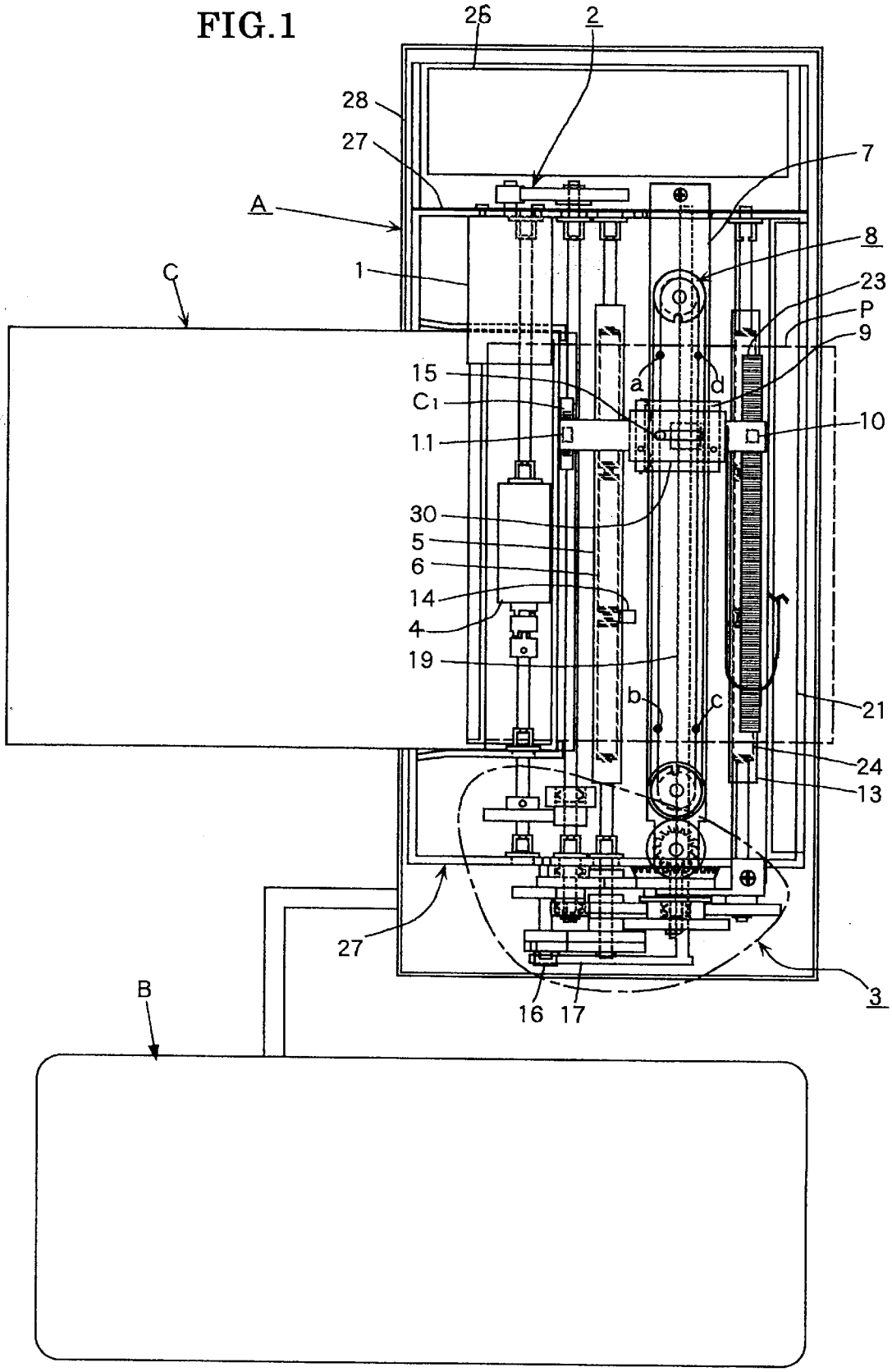
FIG. 1 is a plan view illustrating an image processing system having a printer and an image processing apparatus of substantially actual size according to an embodiment of the present invention.
Figure 2:
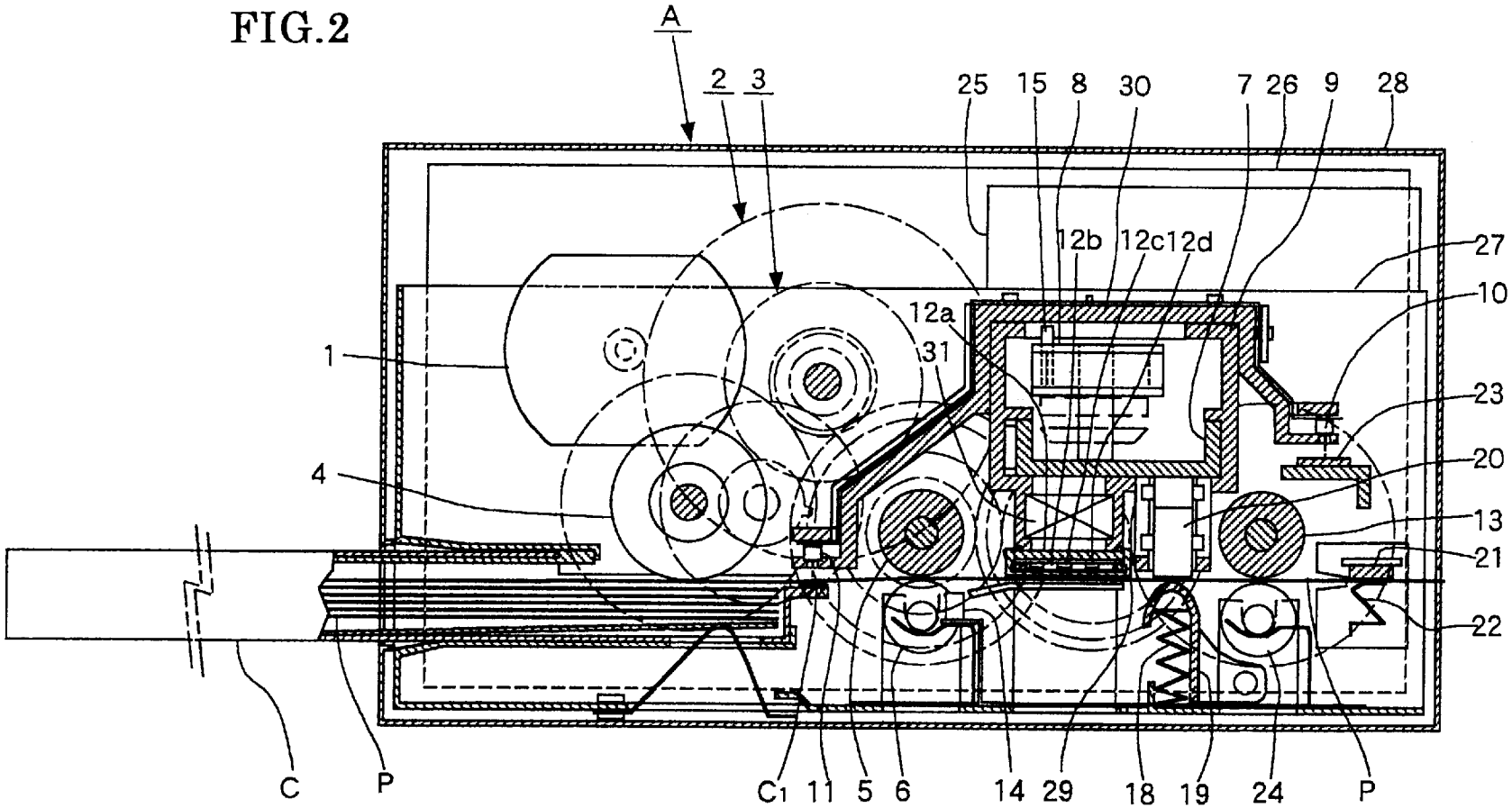
FIG. 2 is an enlarged sectional view of the printer of FIG. 1 seen from the direction.
Figure 3:
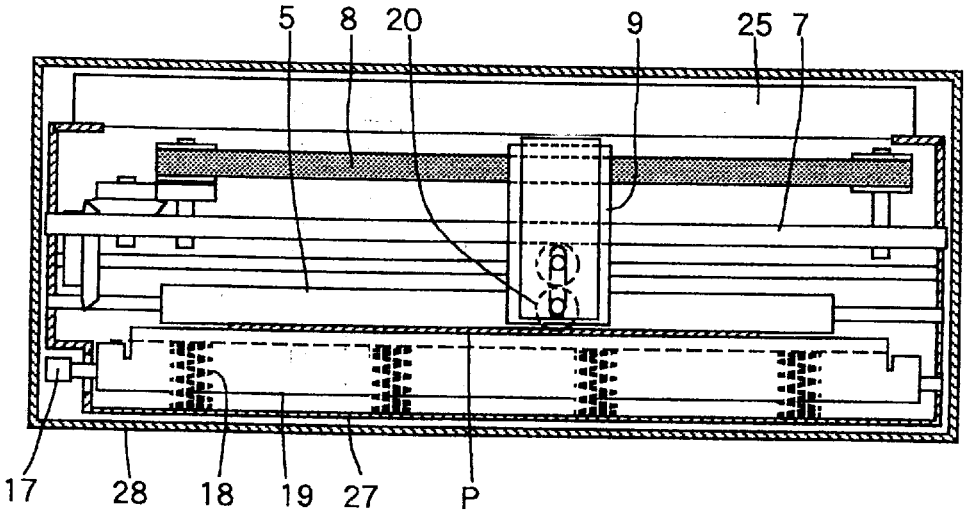
FIG. 3 is a sectional view of the printer of FIG. 1 seen from the side direction where printing paper is discharged.

First, outline of the structure of an image processing system having a printer and an image processing apparatus according to a first embodiment of the present invention is described with reference to the drawings.

As shown in FIG. 1 to FIG. 4, in the system, when a power switch (not shown) is turned on, image data stored in an image processing apparatus B is selected, and a print image output switch (not shown) is turned on, a printer A carries out print.

When the power switch is turned on, a motor 1 rotates by a predetermined number of rotations in a counterclockwise direction. The rotation of the motor 1 is transmitted through a train 2 of gears on the side of the motor and a train 3 of gears on the side opposite to the motor to a pickup roll 4. This makes the pickup roll 4 rotate to feed sheets of printing paper P one by one from a cassette C. The fed printing paper P is sandwiched between a feed roll 5 on the upstream side and three pinch rolls 6 below the feed roll 5. At the same time, a belt drive mechanism 8 with a winding belt thereon provided on a carriage guide 7 makes a carriage 9 reciprocate substantially once which is engaged with and guided by the carriage guide 7, and the carriage 9 travels to a home position. When the carriage 9 returns to the home position, the motor 1 stops its rotation.

Further, at this time, a bar code sensor 11 provided on a bracket 30 for attaching sensors reads a bar code C1. attached to a cassette C to determine the type of printing paper. According to the kind of the printing paper read here, the intensity or irradiation time of light by light emitting diodes 12*b,* 12*c,* and 12*d* forming a head provided on the carriage 9 is controlled.

Next, when a print image output switch (not shown) is turned on, first, the motor 1 rotates in a clockwise direction to feed the printing paper P by rotating the pickup roll 4, the feed roll 5, and a feed roll 13 through the trains 2 and 3 of gears. A paper feed confirming sensor 14 provided on the carriage 9 and located on the downstream side of the feed roll 5 senses the front edge of the printing paper P.

When the printing paper P is sensed, the motor 1 stops its rotation for a time, and immediately after that, rotates in the counterclockwise direction. This counterclockwise rotation makes the carriage 9 reciprocate through the belt drive mechanism 8 with a winding belt thereon. At the same time, a linear sensor 10 provided on the bracket 30 for attaching sensors attached to the carriage 9 reads the graduations of a linear scale 23 to detect the position of the travel. At the same time with the reciprocation of the carriage 9, the light emitting diodes 12*b,* 12*c,* and 12*d* forming the head formed on a substrate 12*a* provided on the carriage 9 emit flashing light correspondingly to the image data input from the image processing apparatus B. The light is, after the light diameter is decreased by pinholes of an aperture 29, irradiated onto the printing paper P to make uncollapsible microcapsules that are lighted by light of predetermined wavelengths. While a circulating pin 15 makes a U-turn from a position b to a position c, and while it makes a U-turn from a position d to the home position a, a cam 16 presses down a cam follower 17 by a small amount, and the feed rolls 5 and 13 in conjunction with the pinch rolls 6 and 24 feed the printing paper P by about 0.2 mm. On the other hand, while the circulating pin 15 moves linearly from the home position a to the position b, and while it moves linearly from the position c to the position d, the cam 16 releases the cam follower 17 from being pressed down, and thus, a platen 19 is lifted up by a spring 18 and a rolling roller 20 effectively pressurizes the printing paper P as if a straight line is drawn to selectively collapse only microcapsules that are not irradiated with light of the predetermined wavelengths and does not harden. These operations are repeated to selectively collapse microcapsules over the whole surface of the printing paper P. The printing paper P passes between a heater 21 and a leaf spring 22. Here, color development material that gets in contact with an image receiving layer by the collapse of the microcapsules is slidably contacted and is heated, and color developing is facilitated instantaneously to produce an image.

The carriage guide 7 has linearity of high accuracy and is formed to be channel-shaped. Its ribs on both sides are held by channel portions on both sides of the carriage 9. The substrate 12*a* is precisely positioned with respect to the carriage 9 by being sandwichingly fixed. The light emitting diodes 12*b,* 12*c,* and 12*d* are formed together with circuit wirings on an insulating layer formed on the substrate 12*a,* and are connected with the circuit wirings by bonding. The circuit wirings are connected with flexible printed wirings.

It is to be noted that reference numerals 25, 26, 27, and 28 denote a controller, a battery, a chassis, and a case, respectively.

Figure 4:
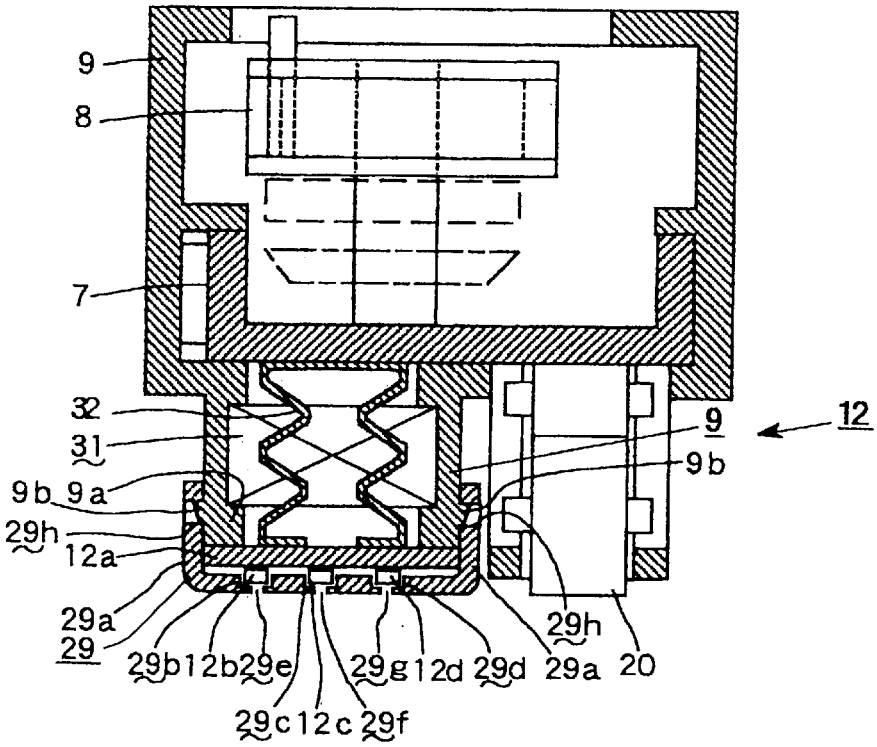
FIG. 4 is a partial enlarged sectional view illustrating a carriage guided by a carriage guide and a printing head device supported by the carriage.

FIG. 4 is a partial enlarged sectional view illustrating the carriage 9 guided by the carriage guide 7 and a head device 12 supported by the carriage 9.

First, the relationship of the arrangement of the plurality of light emitting elements 12*b,* 12*c,* and 12*d* formed on the substrate 12*a* forming the head and of the concave portions and the pinholes of the aperture member 29 is described.

The aperture member 29 has on its both ends sandwiching portions 29*a* and covers the substrate 12*a* with the sandwiching portions 29*a* sandwiching the carriage 9. Concave portions 29*b,* 29*c,* and 29*d* are formed on a surface facing the substrate 12*a* (inner surface) correspondingly to the arrangement of the light emitting diodes 12*b,* 12*c,* and 12*d* forming the head. Pinholes 29*e,* 29*f,* and 29*g* are provided in the bottom walls of the concave portions 29*b,* 29*c,* and 29*d.* A part of the light emitting diodes 12*b,* 12*c,* and 12*d* is housed in the concave portions 29*b,* 29*c,* and 29*d* without contacting them. It is preferable that the depth of the concave portions is defined such that the distance between the light emitting surfaces of the light emitting diodes 12*b,* 12*c,* and 12*d* and the printing paper P located so as to face the aperture 29 is as small as possible. This is because, by making the distance smaller, the light energy received on the printing paper P can be made larger. Further, it is preferable that, with regard to the range of the light emitting diodes 12*b,* 12*c,* and 12*d* housed in the concave portions, at least the light emitting portions of the light emitting diodes are covered with the concave portions. By covering the light emitting portions in this way, leakage of light to other pinholes can be prevented. Insulating black coat is formed on the surface of the aperture 29 facing the substrate 12*a,* particularly on the inner surfaces of the concave portions 29*b,* 29*c,* and 29*d.* As a method of forming black coat, plating treatment with black chromium is known, with which dull black coat with no conductivity can be formed.

In order to form these concave portions and pinholes, after the concave portions 29*b,* 29*c,* and 29*d* are formed by etching, the pinholes 29*e,* 29*f,* and 29*g* are formed by etching from the opposite surface, and the black insulating coat is formed by chemical treatment.

Figure 5A:
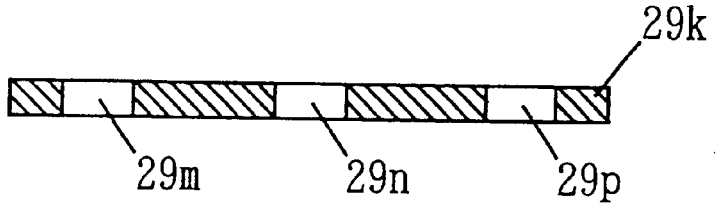
FIG. 5 is a sectional view illustrating another embodiment of an aperture forming a head device according to the present invention.
Figure 5B:
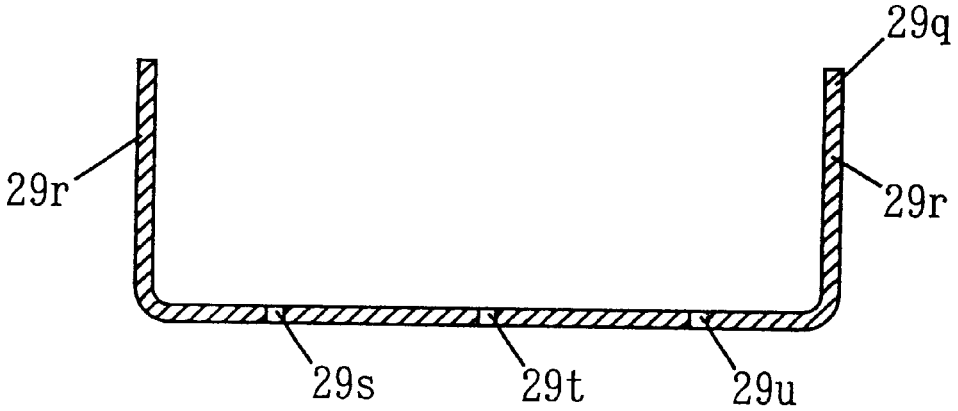
Figure 5C:
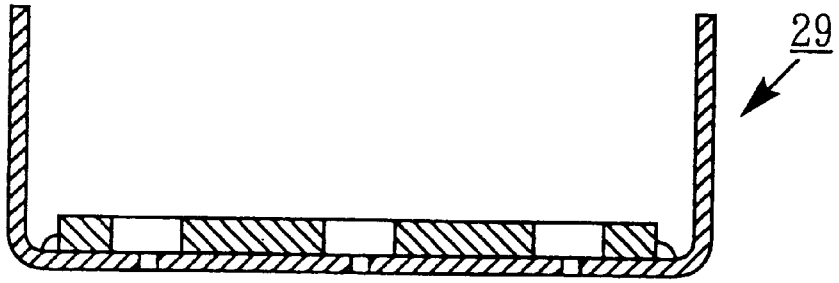

The aperture member 29 may be formed by making two members and connecting them thereafter rather than being formed integrally as described above. FIG. 5 is a sectional view of the aperture 29 structured with two members. In this case, one of the members 29*k* is a plate-like member as illustrated in FIG. 5A, which is provided with holes 29*m,* 29*n,* and 29*p* corresponding to the above concave portions for housing the above light emitting diodes 12*b,* 12*c,* and 12*d* therein. The other member 29*q* is shaped such that sandwiching portions 29*r* are provided on its both end portions as illustrated in FIG. 5B. Pinholes 29*s,* 29*t,* and 29*u* corresponding to the above pinholes are provided at positions of the above light emitting diodes 12*b,* 12*c,* and 12*d.* As illustrated in FIG. 5C, when these two members are on top of each other, the pinholes 29*s,* 29*t,* and 29*u* are adapted to be in the center of the holes 29*m,* 29*n,* and 29*p,* respectively. After these two members are on top of each other in this way, they are combined with each other by welding. Insulating black coat is formed on the inner surfaces of the holes 29*m,* 29*n,* and 29*p* and on the surface of the second member 29*q* where the holes 29*m,* 29*n,* and 29*p* are positioned as in the integrally formed aperture 29.

Since the aperture 29 is structured as described above, even if, due to improper assembling, the bonding conductors connecting the respective top portions of the light emitting elements 12*b,* 12*c,* and 12*d* with the substrate 12*a* comes into contact with the concave portions 29*b,* 29*c,* and 29*d,* since the insulating black coat is formed on the surfaces of the concave portions 29*b,* 29*c,* and 29*d,* electric short circuit can be prevented, and, light emitted from the respective top portions of the light emitting elements 12*b,* 12*c,* and 12*d* can be irradiated through the pinholes 29*e,* 29*f,* and 29*g* in front of the concave portions 29*b,* 29*c,* and 29*d* onto the printing paper which is several micrometers away from the aperture 29. On the other hand, with regard to light from the light emitting elements 12*b,* 12*c,* and 12*d* which does not pass through the pinholes 29*e,* 29*f,* and 29*g,* the absorbed quantity of light is large since the coating on the surfaces of the concave portions 29*b,* 29*c,* and 29*d* is black. Before light leaked from any one of the concave portions 29*b,* 29*c,* and 29*d* comes into any other one of the concave portions 29*b,* 29*c,* and 29*d* to pass through the pinhole, the light is repeatedly reflected, and, in that process, is absorbed by the black coat. Accordingly, light leaked from any one of the concave portions 29*b,* 29*c,* and 29*d* does not at all come into any other one of the concave portions 29*b,* 29*c,* and 29*d* to pass through the pinhole to affect the print.

Next, a device is described for avoiding a situation where, due to heat accompanying the flashing light emitted by the light emitting diodes 12*b,* 12*c,* and 12*d,* the temperature of the substrate 12*a* rises to the melting point of the plastic forming the carriage 9 (about 130° C., for example) to, without cooling, melt and change the shape of the substrate 12*a,* a substrate supporting portion of the carriage 9, and the aperture.

The substrate 12*a* is formed of a metal plate having high heat conductivity, and a heat radiating means for radiating heat of the substrate 12*a* is provided. The substrate 12*a* is formed of a metal plate having high heat conductivity such as an aluminum plate, a stainless steel plate, and a nickel plate. The heat radiating means for the heat of the substrate 12*a* is provided as a complex of two heat radiating means. A first heat radiating means is air holes 31 opened on both sides of a box-shaped substrate support portion 9*a* of the carriage 9 in the travelling direction of the carriage. A second heat radiating means is heat radiating fins 32 attached to the rear surface of the substrate and made of metal having high heat conductivity such as an aluminum plate, a stainless steel plate, and a nickel plate. It may be that only one of the heat radiating means may be provided.

Accordingly, when the carriage 9 travels, air in the printer circulates via the air holes 31 through the inner space of the box-shaped substrate supporting portion 9*a* to cool the heat radiating fins 32, and thus, cooling by airflow can be conducted to the temperature at which the substrate supporting portion 9*a* and the aperture 29 do not melt or get soft.

Next, a device is described for making it possible to assemble the aperture 29 to the box-shaped substrate supporting portion 9*a* of the carriage 9 with extreme precision while the aperture member 29 is several micrometers away from the printing paper.

While the aperture member 29 is required to be formed of a material excellent in heat conductivity as described above, since it is attached to the substrate supporting portion 9*a* of the carriage 9 by widening the space between the sandwiching portions 29*a* on its both ends and sandwiching the substrate supporting portion 9*a,* it is required to be of a material that does not keep the deformation when the space between the sandwiching portions 29*a* on its both ends is widened and that can retain the sandwiching force. In view of this point, particularly, the aperture is preferably formed of copper or copper alloy having excellent heat conductivity and elasticity, and in particular, phosphor bronze. Further, it is structured such that, when the space between the sandwiching portions 29*a,* 29*a* is slightly widened and the aperture 29 is pressed toward the substrate 12*a,* the inner surfaces of the sandwiching portions 29*a,* 29*a* are pressed against wedge-shaped front surfaces of cylinder-like protrusions 9*b* provided on both ends of the substrate support portion 9*a* of the carriage 9 to widen the space between the sandwiching portions 29*a,* thereby sandwichingly fixing the aperture member to the substrate support portion 9*a* at at a postion where round holes 29*h* provided on the sandwiching portions 29*a* face the cylinder-like protrusions 9*b*. In this way, it is made possible to assemble the aperture 29 to the substrate supporting portion 9*a* of the carriage 9 with extreme precision.

As described above, according to a head device, a printer, and an image processing system of the present invention, (1) since light emitted from a plurality of light emitting elements formed on a substrate forming a head does not leak out from a pinhole of a non-corresponding position of an aperture and light emitted from the plurality of light emitting elements does not mutually interfere, satisfactory print can be carried out;

(2) since the distance from the light emitting elements to the printing paper can be made smaller, the light energy received on printing paper can be made larger;

(3) since the substrate and the aperture can be cooled, cooling to the temperature at which a substrate supporting portion of a carriage and the aperture do not melt or get soft can be conducted, and thus, abnormal heating of the head can be avoided, the fear of thermal metamorphosis is dissolved to assure the duration of printer life, and metamorphosis of printing paper due to heat radiation of the aperture can be avoided; and (4) since the aperture member can be assembled with ease, the sandwichingly fixing state of the aperture can be maintained sufficiently even after a long time, and since the shift of position of the aperture member does not occur, the aperture member does not contact printing paper which is several micrometers away, so that the color of the printing paper does not change due to heat of the aperture member.

What is claimed is:

1. A print head device comprising: a plurality of light emitting elements for irradiating light onto a printing paper to carry out printing; and an aperture member having:

a plurality of concave portions formed therein corresponding to the arrangement of the light emitting elements and pinholes formed substantially at the center of the respective concave portions for decreasing a diameter of the light emitted by the respective light emitting elements; wherein the aperture member is arranged so that at least a part of the light emitting elements are disposed within the concave portions without contacting a surface of the aperture member.

2. A print head device as claimed in claim 1; further comprising an insulating black coat formed on a surface of the aperture member facing the light emitting elements and covering at least the concave portions.

3. A print head device as claimed in claim 1; further comprising a substrate on which the light emitting elements are provided; and wherein the aperture member is formed of metal having high heat conductivity and is arranged so as to be in contact with the said substrate.

4. A print head device as claimed in claim 3; wherein the aperture member has fixing portions for fixing a carriage thereto by sandwiching therebetween the carriage.

5. A print head device as claimed in claim 3; wherein the metal having a high heat conductivity comprises one of copper and an alloy of copper.

6. A printer head device as claimed in claim 3; wherein the metal having a high heat conductivity comprises phosphor bronze.

7. A print head device as claimed in claim 3; wherein the substrate is formed of a metal having a high heat conductivity; and further comprising heat radiating means for radiating heat produced by the substrate.

8. A printer having a print head device as claimed in any one of claims 1 to 7; wherein the print head is arranged so that light emitted by the light emitting elements is decreased in diameter by the aperture and irradiated onto printing paper to produce an image on the printing paper.

9. An image processing system, comprising:

a connecting printer according to claim 8; and an image processing apparatus connected to the printer for transmitting/receiving image signals between the image processing apparatus and the printer to produce an image on the printing paper.

* * * * *